US011367984B2

(12) United States Patent
Mitter

(10) Patent No.: US 11,367,984 B2
(45) Date of Patent: Jun. 21, 2022

(54) ADAPTIVE CONNECTOR

(71) Applicant: ODU GmbH & Co. KG, Muehldorf am Inn (DE)

(72) Inventor: Alfred Mitter, Heldenstein (DE)

(73) Assignee: ODU GMBH & CO. KG, Muehldorf am Inn (DE)

( * ) Notice: Subject to any disclaimer, the term of this patent is extended or adjusted under 35 U.S.C. 154(b) by 0 days.

(21) Appl. No.: 17/126,189

(22) Filed: Dec. 18, 2020

(65) Prior Publication Data

US 2021/0194191 A1 Jun. 24, 2021

(30) Foreign Application Priority Data

Dec. 23, 2019 (EP) ..... 19219502

(51) Int. Cl.
*H01R 13/66* (2006.01)
*H01R 24/54* (2011.01)
(Continued)

(52) U.S. Cl.
CPC ..... *H01R 24/542* (2013.01); *H01R 9/0506* (2013.01); *H01R 35/04* (2013.01)

(58) Field of Classification Search
CPC ... H01R 13/6315; H01R 12/91; H01R 12/585
(Continued)

(56) References Cited

U.S. PATENT DOCUMENTS 5,055,055 A 10/1991 Bakker
9,653,831 B2 * 5/2017 Hoyack ..... H01R 12/91
(Continued)

FOREIGN PATENT DOCUMENTS

CN 201699177 U 1/2011
CN 102738612 A 10/2012
(Continued)

*Primary Examiner* — Phuong Chi Thi Nguyen
(74) *Attorney, Agent, or Firm* — WCF IP

(57) ABSTRACT

An adaptive connector comprising a contact jack and a lamella comb, wherein the lamellae of the lamella comb electrically contact the contact jack, characterised in that the contact jack is connected in a mechanically inseparable but movable manner with the lamella comb. The contact jack can be pivoted relatively to the lamella comb with an angular range of more than 2 degrees while maintaining contact between the contact jack and the lamellae of the lamella comb, and/or the contact jack can be moved translationally relatively to the lamella comb in at least one direction within a translational range of more than 1 millimetre. Moreover, an adaptive connector comprising two or more adapter elements that are electrically separate from each other. Each adapter element comprises a connection jack or a connection lamella device at each of two ends of the adapter element, the connection jack or connection lamella device of one end being electrically connected to the connection jack or connection lamella device of the other end. The adapter elements are connected with each other in a mechanically inseparable but movable manner. Any of the adapter elements can be pivoted relatively to at least one other of the adapter elements with an angular range of more than 4 degrees and/or any of the adapter elements can be moved translationally relatively to any other of the adapter elements in at least one direction by more than 2 millimetre. Finally, a system comprising the adaptive connector and a counter connector.

15 Claims, 9 Drawing Sheets

(51) Int. Cl.
*H01R 9/05* (2006.01)
*H01R 35/04* (2006.01)

(58) Field of Classification Search
USPC ..... 439/248, 247
See application file for complete search history.

(56) References Cited

U.S. PATENT DOCUMENTS

| | | | |
|---|---|---|---|
| 2014/0170886 | A1 | 6/2014 | Kikuchi et al. |
| 2015/0118899 | A1 | 4/2015 | Hugel |

FOREIGN PATENT DOCUMENTS

| | | | |
|---|---|---|---|
| CN | 105247738 | A | 1/2016 |
| EP | 1207592 | A2 | 5/2002 |
| EP | 2209167 | A1 | 7/2010 |
| EP | 2755282 | A1 | 7/2014 |
| JP | 2002231375 | A | 8/2002 |
| JP | 2013093124 | A | 5/2013 |
| WO | 2000502788 | A1 | 9/2000 |
| WO | 2009076310 | A2 | 6/2009 |
| WO | 2011088902 | A1 | 7/2011 |

* cited by examiner

ADAPTIVE CONNECTOR

FIELD OF THE INVENTION

The invention relates to an adaptive connector comprising a contact jack and a lamella comb or two contact jacks. The invention further relates to an adaptive connector comprising two or more adapter elements that are electrically separate from each other. Moreover, the invention relates to a system comprising an adaptive connector and a counter connector.

BACKGROUND OF THE INVENTION

From CN102738612 A1 a coaxial connector is known that can connect two coaxial connector sockets attached to two opposite circuit boards. The coaxial connector can be tilted in order to compensate for a relative displacement of the circuit boards. To facilitate such compensatory action, on both ends of the connector, an inner socket for receiving a central terminal of the coaxial sockets is pivotably arranged relatively to the remainder of the coaxial connector. A similar connector but without the pivotable inner socket is known from CN 201699177 U.

EP 1 207 592 A2 discloses a contact sleeve for connecting a first and a second coaxial connector socket, wherein the contact sleeve can be tilted in order to compensate for a relative displacement of coaxial connector sockets. Engagement means are provided to allow the contact sleeve to snap-lock into the first coaxial connector sockets. The contact sleeve can compensate for a lateral displacement as well as a varying distance between the first and a second coaxial connector.

In EP 2 755 282 A1 a combination of a first and a second coaxial radio frequency connector is disclosed, in which an adapter provides a flexible link between the first and the second radio frequency connector. The connectors as well as the adapter have a square geometry. The adapter comprises an inner contact, an insulator supporting said inner contact, and an outer ground body holding said inner contact and said insulator. An end of the insulator extends beyond the inner contact and the outer ground body. The end of the insulator has a lead-in geometry.

WO 2000/52788 A1 describes a coaxial connection for a printed circuit board comprising an essentially cylindrical adapter for electrically connecting and a second connector element. With its first end, the adapter is connected to the first connector element by means of a ball-and-socket joint in such a way that the adapter can be tilted around the centre of the fixed ball-and-socket joint in a limited manner and without the application of forces thereon.

From WO 2011/088902 A1 a coaxial connector is known that comprises first and second connector parts and an adapter arranged between them. In a socket area of a first inner conductor of each connector part, a first mechanical operative-connection means is arranged, which interacts with a second mechanical operative-connection means of the adapter in the installed state to establish a mechanical connection that is effective in the axial direction. The first inner conductor protrudes beyond the level of the mechanical operative-connection means in the axial direction in such a way that the active area of an internal cylindrical contact surface of the connector parts is able to compensate a large axial offset of the connector parts relative to the adapter.

WO 2009/076310 A2 discloses an electrical connector for connecting two elongated members that are positioned in-line to one another that can accommodate angular and axial offset. The connector has a housing with an outer sleeve defining a longitudinal bore with two sections. In each section, a retaining cylinder is slidably arranged. Canter-coil springs is provide electrical contact between the sleeve and the retaining cylinders.

From EP 2 209 167 A1, an electrical connector for high temperature environments with a lamella basked is known, in which the lamellae are fixed to each other on both ends. The lamella basked is fixed to a lamella carrier by clamping between screw-joined parts of the lamella carrier.

OBJECT OF THE INVENTION

It is an object of the present invention to provide an improved adaptive connector comprising a contact jack and a lamella comb or two contact jacks. The invention further aims at providing an improved adaptive connector comprising two or more adapter elements that are electrically separate from each other. The invention moreover seeks to provide a system comprising an adaptive connector and a counter connector. In particular, the invention aims at providing an adaptive connector that can compensate misalignment between connection jacks or connection lamella devices of the adaptive connector and a counter connector and a system of an adaptive connector and a counter connector that provide for such compensation.

Solution According to the Invention

In the following, any reference to one (including the articles "a" and "the"), two or another number of objects is, provided nothing else is expressly mentioned, meant to be understood as not excluding the presence of further such objects in the invention. The reference numerals in the patent claims are not meant to be limiting but merely serve to improve readability of the claims.

According to a first aspect of the invention, the problem is solved by an adaptive connector with the features of claim 1. The adaptive connector comprises a contact jack and a lamella comb, wherein the lamellae of the lamella comb electrically contact the contact jack. The contact jack is connected in a mechanically inseparable but movable manner with the lamella comb, and the contact jack can be pivoted relatively to the lamella comb within an angular range of more than 2 degrees (with regard to a 360 degree full circle) while maintaining contact between the contact jack and the lamellae of the lamella comb, and/or the contact jack can be moved translationally in at least one direction within a translational range of more than 1 millimetre. It is an achievable advantage of this aspect of the invention that due to the contact jack being pivotable or translationally movable relatively to the lamella comb, the adaptive connector can compensate for a relative misalignment, such as a tilt or an offset, of the contact jack and the lamellae comb.

In the context of the present invention, a "lamella comb" is an arrangement of more than two elastically resilient lamellae extending in the same general direction. The lamellae of the lamella comb can be joined with a matching contact jack to establish an electrical contact between the lamella comb and the contact jack. For this purpose, the preferred lamellae of the lamella comb can be elastically deflected in a direction perpendicularly to a surface in which the lamella comb extends. This can allow the lamella to be elastically biased against the contact jack to provide for a reliable electrical contact.

A "contact jack" in the context of the present invention can be either male or female, i.e., it can be a contact pin or a contact sleeve. The contact pin can be slotted or non-slotted. The slot(s) of a preferred slotted contact pin extend in the longitudinal direction of the contact pin. A preferred contact pin has one slot. Another preferred pin has two slots, the two slots more preferably crossing each other, most preferably in a right angle. Likewise, the contact sleeve can be slotted or non-slotted. The slot(s) of a preferred slotted contact sleeve extend in the longitudinal direction of the contact sleeve. A preferred slotted contact sleeve has two slots, which are on opposite sides of the sleeve. Another preferred slotted contact sleeve has four equidistant slots. Contact pins and contact sleeves that cooperate with lamella combs preferably are non-slotted. Likewise, contact pins and contact sleeves that cooperate with slotted contact sleeves or contact pins, respectively, preferably are non-slotted.

According to another aspect of the invention, the problem is solved by an adaptive connector of claim 5. The adaptive connector comprises two or more adapter elements that are electrically separate from each other. Each adapter element comprises a connection jack or a connection lamella device at each of two ends of the adapter element. The connection jack or connection lamella device of one end of each adapter element is electrically connected to the connection jack or connection lamella device of the other end of the adapter element. The adapter elements are connected with each other in a mechanically inseparable but movable manner. Any of the adapter elements can be pivoted relatively to at least one other of the adapter elements within an angular range of more than 4 degrees, and/or any of the adapter element can be moved translationally relatively to any other of the adapter element in at least one direction within a translational range of more than 2 millimetres. It is an achievable advantage of the invention that the connection jacks and/or connection lamella devices can be tilted and/or translated independently from each other. Such an adaptive connector can, advantageously, be used as an adapter for connecting two counter connectors and compensate for a misalignment such as a tilt or an offset, of the connection jack(s) and/or the connection lamella device(s) of the counter connectors.

In the context of the present invention, a "lamella device" comprises a lamella carrier and at least one lamella comb, the lamella comb(s) being inseparably attached to the lamella carrier. A preferred lamella comb is provided with such lamella carrier to from a lamella device. Typically, for attachment, the lamella comb(s) is/are clamped between two parts of the lamella carrier. For example, in the case of a lamella comb in the form of a lamella basket (as defined below), it may be clamped between the inside of a cylindrical bushing of the lamella carrier and an inner ring of the lamella carrier, which ring is grouted against the inside of the bushing. Alternatively, the lamella comb(s) can be clamped between two parts of the lamella carrier that are screw-joined as is for example disclosed in EP 2 209 167 A1, the relevant parts of which are herewith incorporated by reference into the present disclosure. Alternatively, the lamella comb(s) may be welded, for example laser-welded, to the lamella carrier.

The lamella device can either be male or female, i.e. it can either form a stud or a socket. The lamella comb of a stud (male) preferably can cooperate with a matching contact sleeve (female) to form an electrical contact. Similarly, The lamella comb of a socket (female) preferably can cooperate with a matching contact pin (male) to form an electrical contact.

In the context of the present invention, a "connection jack" and a "connection lamella device" is a contact jack and a lamella device, respectively, that is accessible from the outside of the adaptive connector for being joined with a matching mating connection lamella device or mating connection jack, respectively, in order to establish an electrical contact between the connection jack or the connection lamella device, and the mating connection lamella device or mating connection jack.

According to a further aspect of the invention, the problem is solved by an adaptive connector according to claim 13. It comprises a contact pin and contact sleeve, which electrically contact each other. The contact pin and the contact sleeve are connected in a mechanically inseparable but movable manner with each other. The contact pin can be pivoted relatively to contact sleeve within an angular range of more than 2 degrees while maintaining contact, and/or the contact pin can be moved translationally relatively to the contact sleeve in at least one direction within a translational range of more than 1 millimetre.

According to yet another aspect of the invention, the problem is solved by a system according to claim 14. The system comprises an adaptive connector and a counter connector with a matching connection lamella device or a connection jack for each connection jack or connection lamella device, of the adaptive connector for mating the adaptive connector with the counter connector in order to establish an electrical contact between the connection lamella device(s) and/or connection jack(s) of the adaptive connector and the connection jack(s) and/or connection lamella device(s) of the counter connector. It is an achievable advantage of this embodiment of the invention that the adaptive connector and the counter connector can be mated even if they are misaligned, such as a tilted or an offset, relatively to each other. It is preferred that each connection jack of the adaptive connector is adapted to contact a connection lamella device of the counter connector and each connection lamella device of the adaptive connector is adapted to contact a connection jack of the counter connector.

Advantageously, the use of lamella combs and contact jacks can provide for a reliable and at the same time compact construction. Moreover, it can provide for a simple construction with a small number of parts, thereby reducing manufacturing cost and increasing reliability.

The present invention generally can be of advantage in applications where a reliable electrical contact is of importance. It can be of particular use in applications where parts to be electrically connected are misaligned due to manufacturing tolerances. It can also be of particular use in applications where parts to be electrically connected are prone to move relatively to each other due to vibration and/or wear.

PREFERRED EMBODIMENTS OF THE INVENTION

Preferred features of the invention which may be applied alone or in combination are discussed in the following and in the dependent claims.

In a preferred embodiment of the adaptive connector where a contact jack is connected in a mechanically inseparable but movable manner with a lamella comb, the contact jack can be pivoted relatively to the lamella comb within an angular range of more than 2 degrees, more preferably more than 4 degrees, more preferably more than 8 degrees, more preferably more than 10 degrees, while maintaining contact between the contact jack and the lamellae of the lamella comb. The "angular range" in this context is the difference in angular orientation from the outmost orientation in one angular direction and the outmost orientation in the opposite angular direction. Advantageously, with this embodiment of the invention it can be achieved that the adaptive connector compensates for a relative misalignment of the contact jack and the lamellae comb. Preferably, the contact jack can be pivoted relatively to the lamella comb with an angular range of less than 40 degrees, more preferably less than 30 degrees, more preferably less than 20 degrees, more preferably less than 15 degrees, while maintaining contact between the contact jack and the lamellae of the lamella comb. By limiting the angular range of the pivoting, it can be achieved that contact between the contact jack and the lamellae of the lamella comb is maintained at all time.

Similarly, in a preferred embodiment of the adaptive connector where a contact pin is connected in a mechanically inseparable but movable manner with a contact sleeve, the contact pin can be pivoted relatively to the contact sleeve within an angular range of more than 2 degrees, more preferably more than 4 degrees, more preferably more than 8 degrees, more preferably more than 10 degrees, while maintaining contact between the contact pin and the contact sleeve. Advantageously, with this embodiment of the invention it can be achieved that the adaptive connector compensates for a relative misalignment of the contact pin and the contact sleeve. Preferably, the contact pin can be pivoted relatively to the contact sleeve with an angular range of less than 40 degrees, more preferably less than 30 degrees, more preferably less than 20 degrees, more preferably less than 15 degrees, while maintaining contact between the contact pin and the contact sleeve. By limiting the angular range of the pivoting, it can be achieved that contact between the contact pin and the lamellae of the contact sleeve is maintained at all time.

In a preferred embodiment of the adaptive connector, where a contact jack is connected in a mechanically inseparable but movable manner with a lamella comb, the contact jack can be moved translationally relatively to the lamella comb in at least one direction within a translational range of more than 1 millimetres, more preferably more than 1.5 millimetres, more preferably more than 2.5 millimetres, more preferably more than 4 millimetres, while maintaining contact between the contact jack and the lamellae of the lamella comb. The translational range in this context is defined as the shortest distance between the outmost position in a first direction and the outmost position in a direction opposite to the first direction. Advantageously, with this embodiment of the invention it can be achieved that the adaptive connector compensates for a relative misalignment of the contact jack and the lamella comb. Preferably, the contact jack can be moved translationally in at least one direction within a translational range of less than 15 millimetres, more preferably less than 10 millimetres, more preferably less than 7.5 millimetres, more preferably less than 5 millimetres, while maintaining contact between the contact jack and the lamellae of the lamella comb. By limiting range of the translational movement, it can be achieved that contact between the contact jack and the lamellae of the lamella comb is maintained at all time.

Similarly, in a preferred embodiment of the adaptive connector, where a contact pin is connected in a mechanically inseparable but movable manner with a contact sleeve, the contact pin can be moved translationally relatively to the contact sleeve in at least one direction within a translational range of more than 1 millimetres, more preferably more than 1.5 millimetres, more preferably more than 2.5 millimetres, more preferably more than 4 millimetres, while maintaining contact between the contact pin and the contact sleeve. Advantageously, with this embodiment of the invention it can be achieved that the adaptive connector compensates for a relative misalignment of the contact pin and the contact sleeve. Preferably, the contact pin can be moved translationally in at least one direction within a translational range of less than 15 millimetres, more preferably less than 10 millimetres, more preferably less than 7.5 millimetres, more preferably less than 5 millimetres, while maintaining contact between the contact pin and the contact sleeve. By limiting range of the translational movement, it can be achieved that contact between the contact pin and the contact sleeve is maintained at all time.

The above-specified translational movement of the contact jack relatively to the lamella comb or the contact pin relatively to the contact sleeve preferably is essentially in the mating direction. Alternatively or in addition, it is in a direction essentially perpendicular to the mating direction. In the context of the present invention, the mating direction is the direction that is perpendicular to the direction in which the lamellae of the lamella comb or the contact sleeve contact the contact jack or the contact pin, respectively, typically by being biased against the contact jack or the contact pin.

In a preferred embodiment of the adaptive connector where a contact jack is connected in a mechanically inseparable but movable manner with a lamella comb, the contact jack or the lamella comb forms part of an adapter element with the contact jack or lamella comb on one end and a connection jack or a connection lamella device at the other of two ends of the adapter element.

It is preferred that the adaptive connector comprises two or more adapter elements, at least one, to or three, more preferably each with the contact jack or lamella comb on one end and a connection jack or a connection lamella device at the other of two ends of the adapter element.

Preferably, for at least one, to or three, more preferably each of the adapter elements, the adaptive connector comprises a lamella comb or a contact jack that is electrically contacting the contact jack or the lamella comb of the respective adapter element. Also preferably, the lamella comb or the contact jack that the adaptive connector comprises for each of the adapter elements is connected in a mechanically inseparable but movable manner to the contact jack or the lamella comb of the respective adapter element which it is electrically contacting.

The contact jack or lamella comb at one end of the adapter element is, through the adapter element, electrically connected to the connection jack or connection lamella device at the other end. It is preferred that also in each adapter element, the contact jack or lamella comb at one end of the adapter element is, through the adapter element, rigidly mechanically connected to the connection jack or connection lamella device at the other end.

The adapter elements of the adaptive connector preferably are electrically separate from each other. It is preferred that the two or more adapter elements are connected with each other in a mechanically inseparable but movable manner.

In a preferred embodiment of the adaptive connector where two or more adapter elements are connected with each other in a mechanically inseparable but movable manner, at least one, preferably all of the adapter elements can be pivoted relatively to at least one of the other, more preferably any other of the adapter elements with an angular range of more than 4 degrees more preferably more than 8 degrees, more preferably more than 16 degrees, more preferably more than 20 degrees. Advantageously, with this embodiment of the invention it can be achieved that the adaptive connector can compensate for a relative misalignment, of the connection jack(s) and/or the connection lamella device(s) of the adaptive connector and the matching connection lamella device(s) and/or the connection jack(s) of the counter connector to be mated with the adaptive connector. Preferably, at least one, preferably all of the adapter elements can be pivoted relatively to at least one of the other, more preferably any other of the adapter elements with an angular range of less than 80 degrees more preferably less than 60 degrees, more preferably less than 40 degrees, more preferably less than 30 degrees. By limiting the angular range of the pivoting, it can be achieved that contact between the connection jack(s) and/or the connection lamella device(s) of the adaptive connector and the matching connection lamella device(s) and/or the connection jack(s) of the counter connector to be mated with the adaptive connector is maintained at all time.

In a preferred embodiment of the adaptive connector where two or more adapter elements connected with each other in a mechanically inseparable but movable manner, at least one, preferably all of the adapter elements can be moved translationally relatively to at least one of the other, more preferably any of the other adapter elements in at least one direction within a translational range of more than 2 millimetre, more preferably more than 3 millimetres, more preferably more than 5 millimetres, more preferably more than 8 millimetres. Advantageously, with this embodiment of the invention it can be achieved that the adaptive connector can compensate for a relative misalignment of the connection jack(s) and/or the connection lamella device(s) of the adaptive connector and the matching connection lamella device(s) and/or the connection jack(s) of the counter connector to be mated with the adaptive connector. Preferably, at least one, preferably all of the adapter elements can be moved translationally relatively to at least one of the other, more preferably any of the other adapter elements in at least one direction within a translational range of less than 30 millimetre, more preferably less than 20 millimetres, more preferably less than 15 millimetres, more preferably less than 10 millimetres. By limiting the translational movement of the pivoting, it can be achieved that contact between the connection jack(s) and/or the connection lamella device(s) of the adaptive connector and the matching connection lamella device(s) and/or the connection jack(s) of the counter connector to be mated with the adaptive connector is maintained at all time.

The above-specified translational movement of an adapter element relatively to another adapter element preferably is essentially in the longitudinal direction of the adapter elements. Alternatively or in addition, it is in a direction essentially perpendicular to the longitudinal direction of the adapter elements.

The invention also encompasses adaptive connectors comprising two or more adapter elements, in which each adapter element is provided with a connection jack or a connection lamella device at each of its two ends, the connection jack or connection lamella device of one end being electrically connected to the connection jack or connection lamella device of the other end. Such an adaptive connector can, advantageously, be used as an adapter for connecting two counter connects and compensate for a misalignment of these counter connectors.

In some embodiments of the invention, one or more, preferably all of the connection lamella devices are designed to receive a busbar (also sometimes referred to as "conductor rail") to contact it electrically. Electric vehicles typically are provided with such busbars to power the electric traction motor. In one embodiment of the invention, each adapter element is provided with a connection lamella device at each of its two ends, preferably a connection lamella device that can receive an end of a busbar. Thereby, advantageously, the adaptive connector can connect the ends of a first group of busbars with the ends of a second group of busbars while compensation for any misalignment of the busbars.

A preferred adaptive connector according to the invention has three adapter elements. Advantageously, such connector can be used to transfer the three phases of rotary current (also referred to as "three-phase-current"). Particularly preferably, the adaptive connector can connect to a group of three busbars, typically for use in an apparatus using rotary current, for example an electric vehicle, the drive motor of which is driven by a rotary current. An adaptive connector according to the invention may also comprise four, five or more adapter elements.

One or all contact jacks can, in the area provided for contacting the lamellae of the lamella comb, be circularly-symmetrical about a longitudinal axis of the contact jack which extends in the mating direction of the jack. This has the advantage that rotation of the contact does not affect the contact with the corresponding lamella comb. Alternatively or in addition, one or all of the contact jacks, in the area provided for contacting the lamellae of the lamella comb, have a cross-section perpendicularly to the mating direction, with two opposite flat sides. The preferred flat sides are the long sides of a cross-section. Preferably, the flat side are parallel. The preferred cross section is rectangular.

In a preferred lamella comb, the lamellae of the lamella comb are spaced, particularly preferably equally spaced, apart from each other. Preferably, the lamella comb comprises at least 10 lamellae, further preferably at least 16 lamellae, further preferably at least 20 lamellae, further preferably at least 24 lamellae. Preferably, the lamella basket comprises less than 100 lamellae, further preferably less than 70 lamellae, further preferably less than 50 lamellae, further preferably less than 35 lamellae.

When joined, at least one, preferably two or more, even more preferably all lamellae of the lamella comb are in electrical contact with the contact jack. The lamellae of the lamella comb preferably are of an elastic material in order to contribute to their elastically resilient property. In a preferred embodiment of the adaptive connector, when contacting the jack, at least one, preferably two or more, even more preferably all lamellae of the lamella comb are elastically biased against the contact jack.

A preferred lamella comb is a lamella basket. In the context of the present invention, a lamella basket is ring-shaped with the lamellae being arranged spaced from each other along the circumferential direction of the ring. Preferably, the lamellae of the lamella basket are extending perpendicularly to the circumferential direction of the ring. Preferably, the lamellae extend in mainly the direction of the symmetry axis of the ring and inwardly. They can preferably be elastically biased in radial direction against a matching contact jack inserted into the ring for contacting the lamellae of the lamella basket. Such lamella basket can be particularly suitable for contact jacks that are circularly-symmetrical.

Alternatively, the lamella comb extends along a straight line. Particularly preferably, the lamellae extend essentially in the direction perpendicular to the straight line. A preferred adaptive connector comprises at least two lamella combs of the kind in which the lamellae are arranged adjacent to each other along a straight line. Preferably, there is at least one pair of such lamella combs for contacting the same jack. The straight lines of the pair of lamella combs preferably lie within a common plane; particular preferably they extend in parallel to each other. Preferably, the lamellae of each comb of the pair of combs extend in mainly the direction perpendicularly to the common plane and towards the other one of the pair of combs. They can preferably be elastically biased against a matching contact jack inserted between the pair of lamella combs. Such pairs of lamella combs can be particularly suitable for contact jacks that have parallel flat side surfaces facing the lamella combs. They can also be particularly suitable for contacting busbars.

The preferred lamella comb is one-sided in the sense that the lamellae at one end are fixed relatively to each other, which the other end is free to move. The fixed ends can be fixed to each other directly, for example if the lamella comb comprises of a slotted metal sheet, or indirectly, for example if the lamellae are fixed to a common lamella carrier; the latter can for example be achieved by welding or clamping as explained above. Alternatively, the lamella comb can be two-sided in the sense that the lamellae at both ends are fixed relatively to each other, for example as disclosed in disclosed in EP 2 209 167 A1, the relevant parts of which are herewith incorporated by reference into the present disclosure.

In a preferred adaptive connector with one or more adapter element, at least one, two or three, preferably all of the adapter elements are provided on one end with a circularly-symmetrical connection jack or a circularly-symmetrical connection lamella device, and on the other end with a non-circularly-symmetrical connection jack or a non-circularly-symmetrical connection lamella device. It is an achievable advantage of this embodiment of the invention, rotation of the circularly-symmetrical connection jack or connection lamella device can compensate for a rotation of the adapter element about its longitudinal axis due to the same adapter element's non-circularly-symmetrical connection jack or connection lamella device forced to rotate when matching a likewise non-circularly-symmetrical counter connection jack or counter connection lamella device of a counter connector.

In an alternative adaptive connector with one or more adapter element, at least one, two or three, preferably all of the adapter element is provided on both ends with a circularly-symmetrical connection jack or a circularly-symmetrical connection lamella device. In yet an alternative adaptive connector with one or more adapter element, at least one, two or three, preferably all of the adapter element is provided on both ends with a non-circularly-symmetrical connection jack or a non-circularly-symmetrical connection lamella device.

In a preferred adaptive connector, at least one adapter element, preferably all adapter elements is/are provided with an elastic biasing element for biasing the adapter element in a resting position. The resting position of the adapter element preferably is a central position in the sense that from the resting position the adapter element can, essentially by the same amount in opposite directions, be pivoted and moved translationally in a direction perpendicular to the longitudinal extension of the adapter element. In the longitudinal direction of the adapter element, the resting position in which the adapter element is biased by the biasing element preferably is an extreme position, i.e. a position of maximal or minimal distance from the lamella comb(s). The biasing element preferably is of an elastic material, such as silicon rubber.

In a preferred adaptive connector, at least one adapter element, preferably all adapter elements is/are provided with a dampening element for dampening the motion of the adapter element, for example under the influence of vibration. Dampening can reduce the relative motion of the contact jack(s) and/or lamella comb(s) of the adapter element relatively to the corresponding lamella comb(s) and/or jack(s) with which they are mated. This, in turn, can reduce the wear of the surfaces of the lamellae and the jack(s) and thereby increase the useful life of the adaptive connector and the counter connector. The biasing element preferably is of a material with dampening properties, such as silicon rubber. Preferably, the biasing element doubles as the dampening element.

Preferably, at least one adapter element, preferably all adapter elements, is/are provided with one or more seals that seal the adapter element against the housing in order to prevent a fluid from getting from one end to the other end of the adapter element. In a particularly preferred embodiment of the invention, the adapter element's biasing element and/or dampening element doubles as the seal.

At least one connection jack or connection lamella device of the counter connector, preferably all connection jacks or connection lamella devices of the counter connector can be provided with one or more seals that seal the connection jack or connection lamella device of the counter connector against the housing of the adaptive connector in order to prevent a fluid from getting from the outside of the housing to the connection jack or connection lamella device of the counter connector. Alternatively, such seals can be provided on the adaptive connector.

The adaptive connector and the counter connector are particularly suitable for the transfer of high electrical powers. The preferred contact jack and the preferred lamella comb has a core of metal, for example copper or a copper alloy such as a copper-nickel alloy or a copper-chromium alloy. The preferred core is plated, directly or indirectly, with an outer layer of another metal, preferably silver, to provide for a low surface resistance. The core and the outer layer preferably are joined through one or more intermediate metal layers. One such intermediate layer can be of nickel, which, when applied onto the core, due to its hardness can reduce vibration-induced wear. Moreover, a gold layer applied between the nickel layer and the outer layer can improve attachment of the outer layer by reducing oxygen diffusion. The lamella comb may for example be formed as a stamped part, preferably as a stamp-rolled or a stamp-bent part. Preferably, the contact jack(s) and lamella comb(s) are designed such that they can operate at temperature of above 120° C., more preferably above 180° C.

BRIEF DESCRIPTION OF THE DRAWINGS

In the following, further preferred embodiments of invention are illustrated by means of examples. The invention is not limited to these examples, however.

The drawings schematically show.

DETAILED DESCRIPTION OF AN EMBODIMENT OF THE INVENTION

Figure 1:
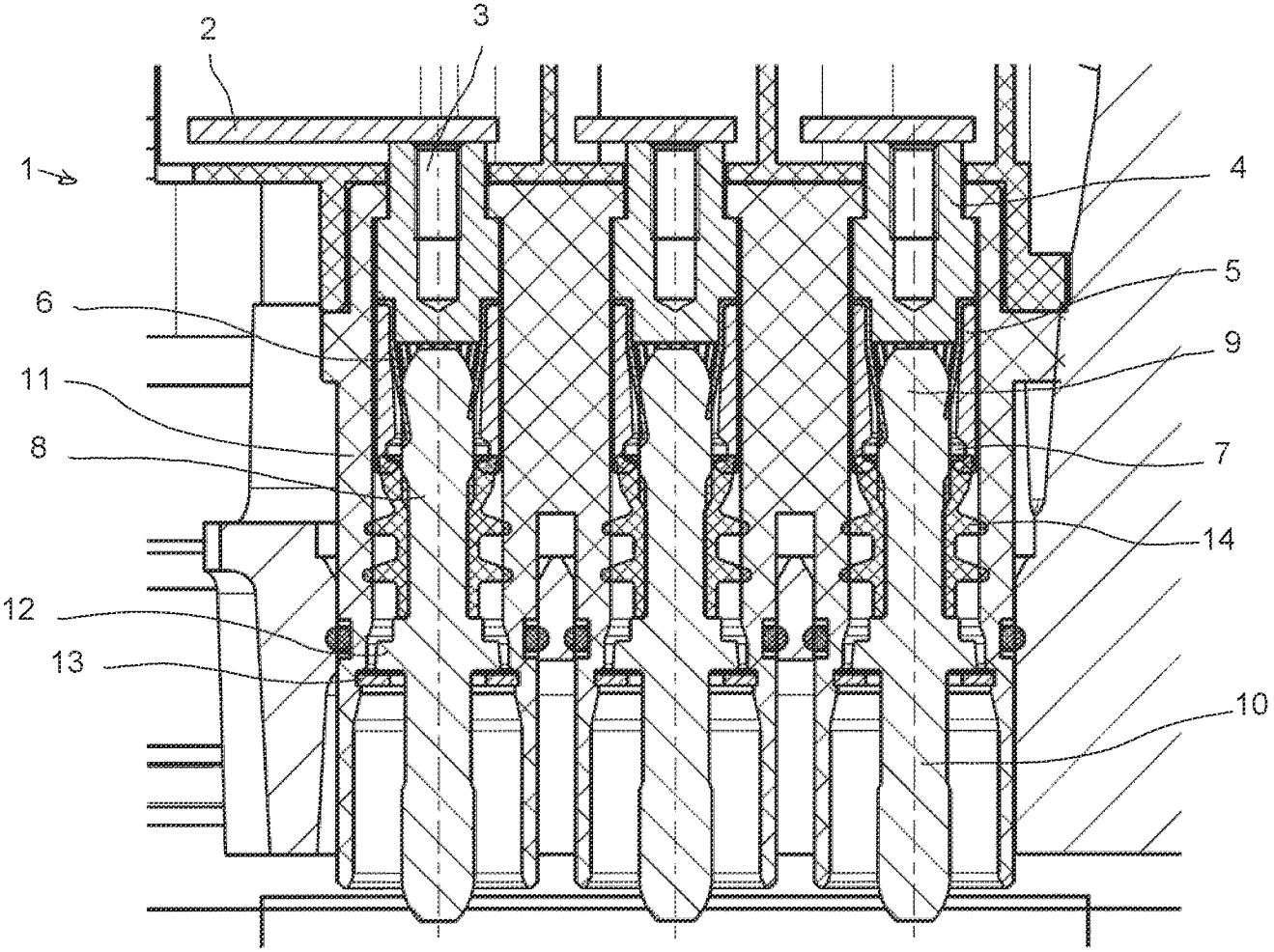
FIG. 1 A cross-sectional view of an adaptive connector with three identical adapter elements, each being provided with contact pins on both sides.

In the following description of preferred embodiments of the invention, identical reference numerals refer to identical or similar components. For clarity, in the case of multiple identical parts in the figure generally only one of these parts is provided with a reference numeral.

The adaptive connector 1 shown in FIG. 1 comprises three lamella carriers to each of which a busbar 2 is attached by means of a screw 3. Both the lamella carriers and the bus bars 2 are of a conductive material, preferably copper or a copper alloy. The lamella carrier comprises a first 4 and a second part 5, between which a one-sided lamella basket 6 is clamped.

The lamella basket 6 is formed of a slotted and bent metal sheet and is resiliently elastic. Each of the lamellae of the lamella basket has a first end, where the lamellae are fixed relatively to each other, and a second, free end. The lamellae extend in mainly the direction of the symmetry axis of the lamella basket 6 and inwardly. The lamellae extend generally along the inner sidewalls of the sleeve-shaped second part 5 of the lamella carrier with the free ends pointing towards a mating opening 7 end of the lamella carrier.

Moreover, three adapter elements 8 are provided that have contact jacks in the form of contact pins 9, 10 on both ends. The contact pins 9 on one end of each adapter element 8, through the respective mating openings 7 of the lamella carriers, extends into the inside of the lamella baskets 6. The lamellae are elastically biased against the contact pins 9 to provide for a reliable electrical contact. The elasticity of the lamellae and the space between the lamellae and the wall of the second part of the lamella carriers 5 allows the contact pin 9 to be pivoted and translationally moved relatively to the lamella carrier while maintaining contact.

The three lamella carriers are fixed in a shared housing 11 and the first parts 4 of the lamella carriers are accessible from the outside of the housing 11 so that the busbars 2 can easily be screwed to the lamella carriers. The adapter elements extend in cylindrical cavities in the housing 11 from the end of the housing 11 where the lamella carriers are located to the opposite end of the housing 11. The contact pins 10 on the ends of the adapter elements 8 opposite those that contact the adaptive connector's 1 lamella carriers are exposed to the outside of the housing 11. They therefore constitute connection pins in the sense of the present invention.

Near the connection pins, each adapter element 8 is provided with a radially extending collar 12 that cooperates with a constriction 13 of the housing's 11 cylindrical cavity to limit the motion of the adapter element 8 in its longitudinal direct and prevent the adapter element to fall out of the housing 11. The diameter of the constriction 13 is larger than that of the part of the adapter element 8 that passes through the constriction; this allows for a tilting and a radial translational motion of the adapter element 8 relatively to the housing 11. Yet, the difference between the diameter of the constriction 13 and the diameter of the part of the adapter element 8 that passes through the constriction also sets limits to the tilting and the translation of the adapter element 8.

At a location along each of the adapter elements 8 between the two contact pins 9, 10, there is provided a silicon rubber collar 14 that serves three functions: It acts as a seal of the adapter element 8 against the housing 11 in order to prevent a fluid from getting from one end to the other end of the adapter element 8; it acts as a dampening element for dampening the motion of the adapter element 8, for example under the influence of vibration; and it acts as a biasing element for biasing the adapter element 8 in a resting position. The resting position of the adapter element 8 is the central position shown in FIGS. 1 and 2 from which the adapter element 8 can, essentially by the same amount in opposite directions, be pivoted and moved translationally in a direction perpendicular to the longitudinal extension of the adapter element 8. In the longitudinal direction, the rubber collar 14 biases the adapter element 8 in the position of maximal distance from the lamella basket 6.

Figure 2:
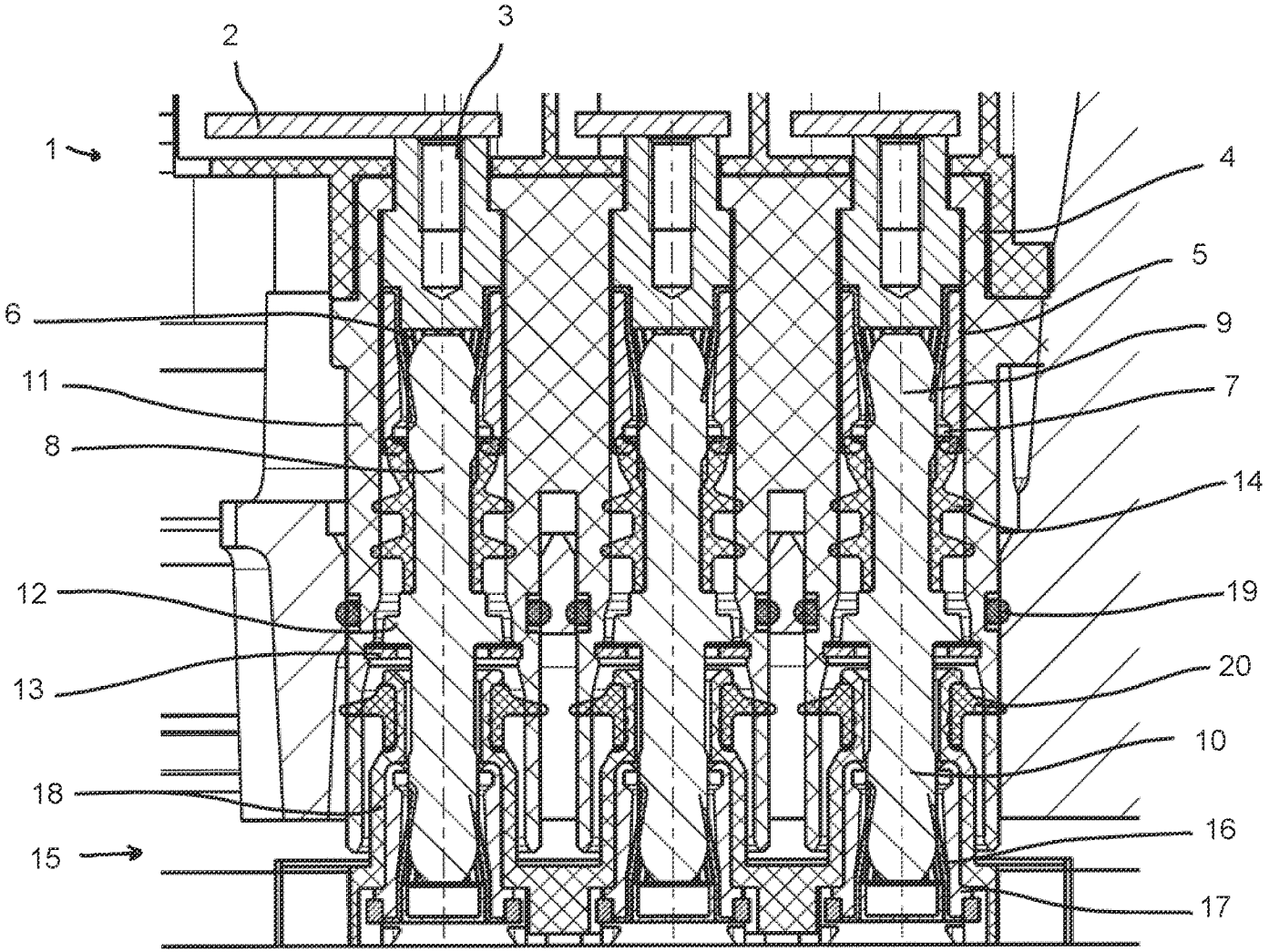
FIG. 2 A cross-sectional view of the adaptive connector of FIG. 1 with a counter connector attracted.
Figure 6:
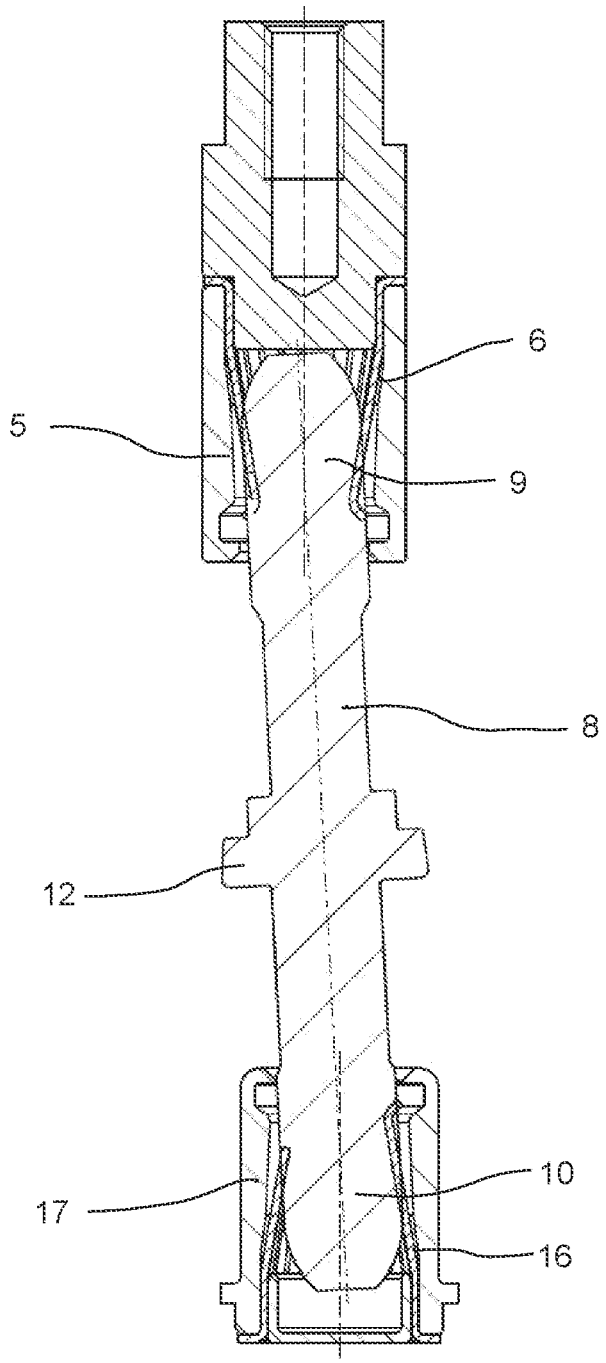
FIG. 6 A cross-sectional view of an adapter element that is provided with a circularly-symmetrical contact pin mated with a matching circularly-symmetrical socket on each end.

In FIG. 2, the adaptive connector 1 is joined with a counter connector 15 that has three connection sockets matching the connection pins 10 of the adaptive connector 1. Each connection sockets comprise a lamella basket 16 arranged in a lamella carrier 17 similarly to the lamella basket and the lamella carriers of the adaptive connector. The connection sockets are fixed in a shared housing 18 of the counter connector 15. The adapter element 8 of FIGS. 1 and 2 with the lamella baskets 6, 16 and the lamella carriers 5, 17 of the adaptive connector 1 and the counter connector 15 is also shown in FIG. 6.

As can be seen in FIG. 2, an O-ring 19 are provided to seal the counter connector 15 against the adaptive connector 1. Moreover, the counter connector 15 is provided with seals 20 that, when the counter connector 15 is attached to the adaptive connector 1, prevents fluids from getting from the outside of the housings 11, 18 into the connection socket of the counter connector 15. These seals 20 of the counter connector seal the outside walls parts of the counter connector 15 that, upon joining the counter connector 15 with the adaptive connector 1, enter into parts of the cavities of the adaptive connector 1 surrounding the connection pins 10, against the inside walls of these parts. Alternatively, the seals 20 can be provided on the adaptive connector 1.

Figure 3:
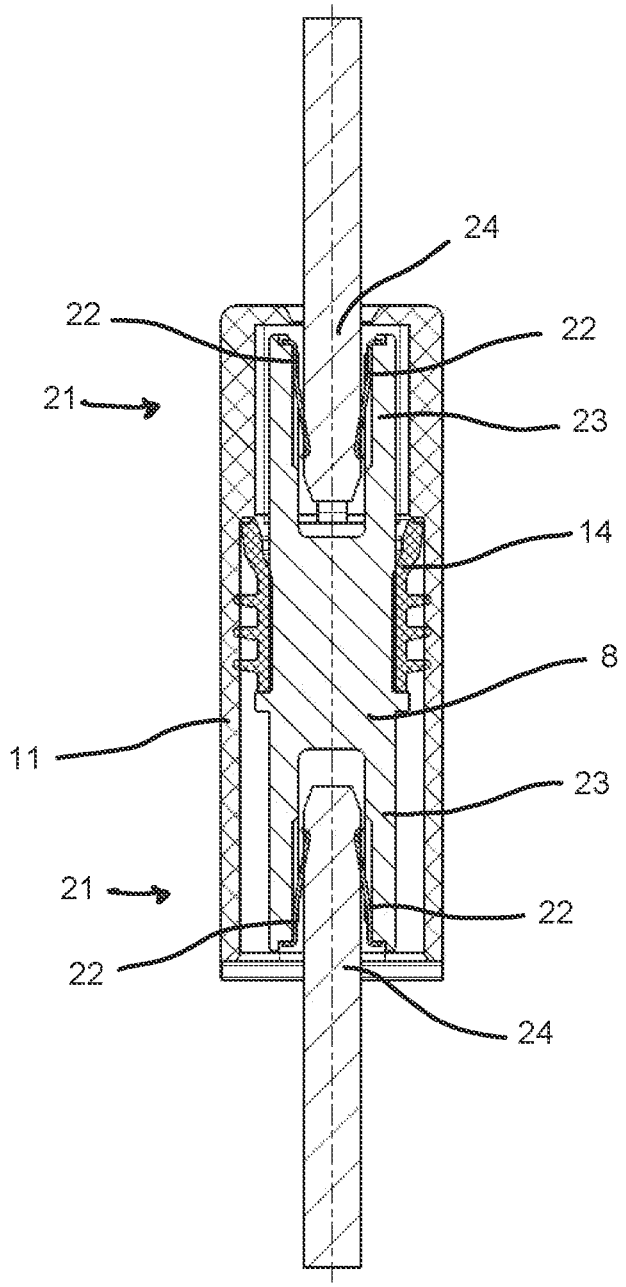
FIG. 3 A cross-sectional view of an adaptive connector with an adapter element that is provided with non-circularly-symmetrical connection sockets and non-circularly-symmetrical connection pins on both ends.
Figure 4:
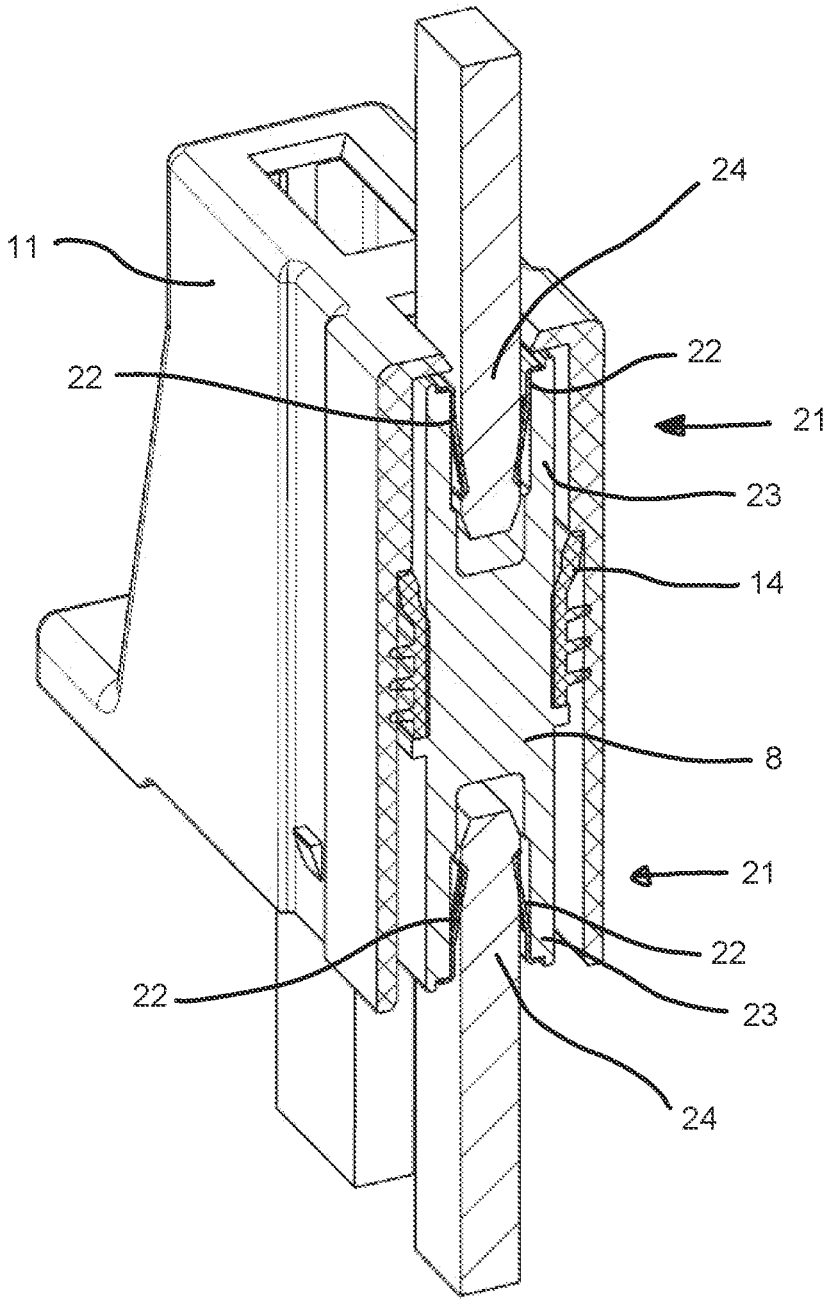
FIG. 4 A perspective cut-away view of the adaptive connector of FIG. 3.

An embodiment of the accommodating connector 1 with adapter elements that have connection lamella elements in the form of non-circularly-symmetrical connection sockets 21 on both ends is shown in FIGS. 3 and 4. As in the case of the adaptive connector 1 of FIGS. 1 and 2, the adaptive connector 1 of FIGS. 3 and 4 comprises three adapter elements 8 in a shared housing 11. Also as in the previous case, at a location along each of the adapter elements 8 between the two connection sockets 21 there is provided a silicon rubber collar 14 that serves as a seal between the adapter element 8 and the housing 11 in order to prevent a fluid from getting from one end to the other end of the adapter element 8, as a dampening element for dampening the motion of the adapter element 8, and as a biasing element for biasing the adapter element 8 in a central resting position and at an extreme position in the longitudinal direction of the adapter element 8.

Each connection socket 21 comprises two parallel one-sided lamella combs 22, which are welded to a lamella carrier 23. The lamellae of each comb 22 of the pair of combs 22 extend mainly along an inner wall of the lamella carrier 23 and towards the other one of the pair of combs 22. They can preferably be elastically biased against a matching non-circularly-symmetrical connection pin inserted between the pair of lamella combs 22. The ends 24 of busbars serve as such connection pins. These ends 24 each are essentially rectangular in cross section.

Figure 5:
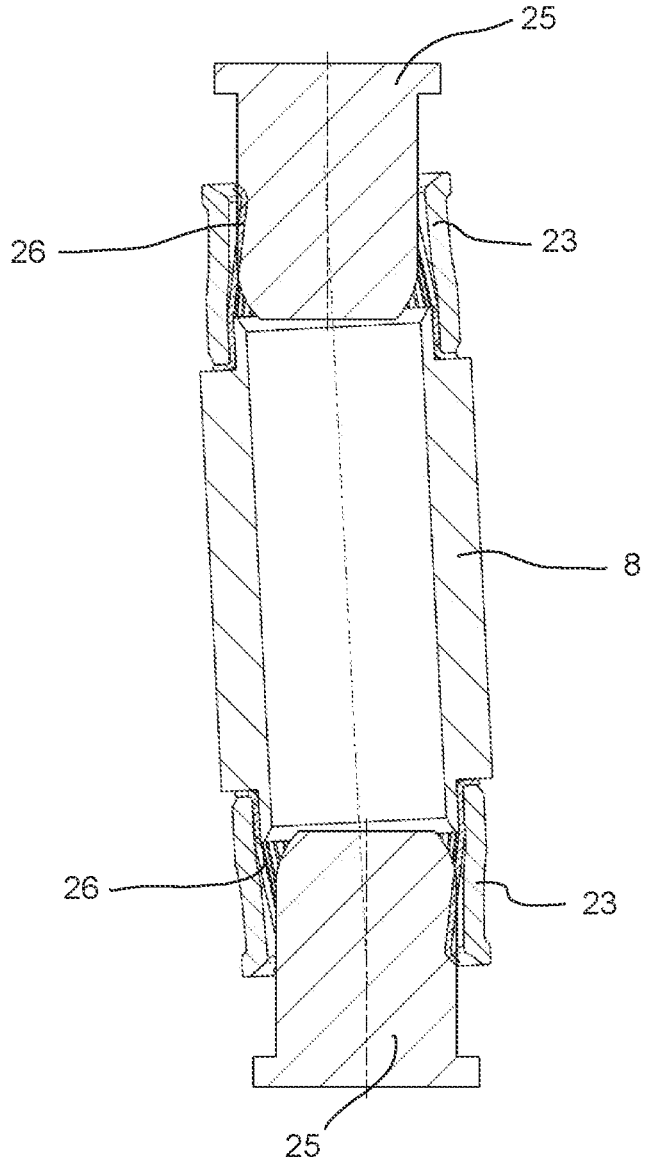
FIG. 5 A cross-sectional view of an adapter element that is provided with a circularly-symmetrical connection socket mated with a matching contact pin on each end.

An alternative embodiment of an adapter element 8 is shown in FIG. 5. Unlike the adapter element 8 of FIGS. 3 and 4, the lamella combs are circularly-symmetrical lamella baskets 26. There is one lamella device at each end of the adapter element 8, each lamella device comprising the lamella basket 26 and a lamella carrier 23. This is also in contrast to the adapter element 8 in FIGS. 1, 2 and 6, where there are circularly-symmetrical contact pins 9, 10 at each end. FIGS. 5 and 6 both show how a contact pin 25, 9, 10 interacts with the lamella basket 26, 6, 16 when the contact pin 25, 9, 10 is slightly tilted relatively to the lamella basket 26, 6, 16. The lamellae are elastically biased against the contact pin 25, 9, 10, thereby compensates for the tilting and ensuring a reliable connection between the lamella basket 26, 6, 16 and the contact pin 25, 9, 10.

Figure 7:
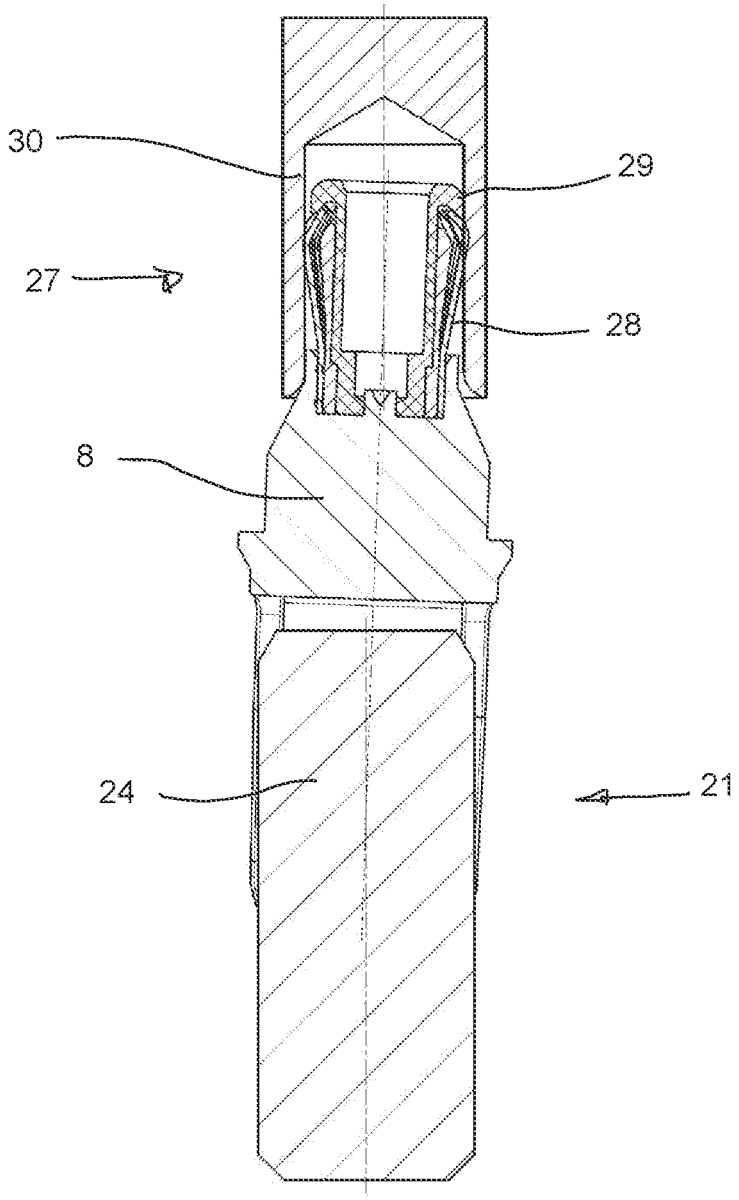
FIG. 7 A cross-sectional view of an adapter element that is provided on one end with a circularly-symmetrical stud mated with a matching circularly-symmetrical contact sleeve, and on the other end with a non-circularly-symmetrical socket mated with a matching contact pin.
Figure 8:
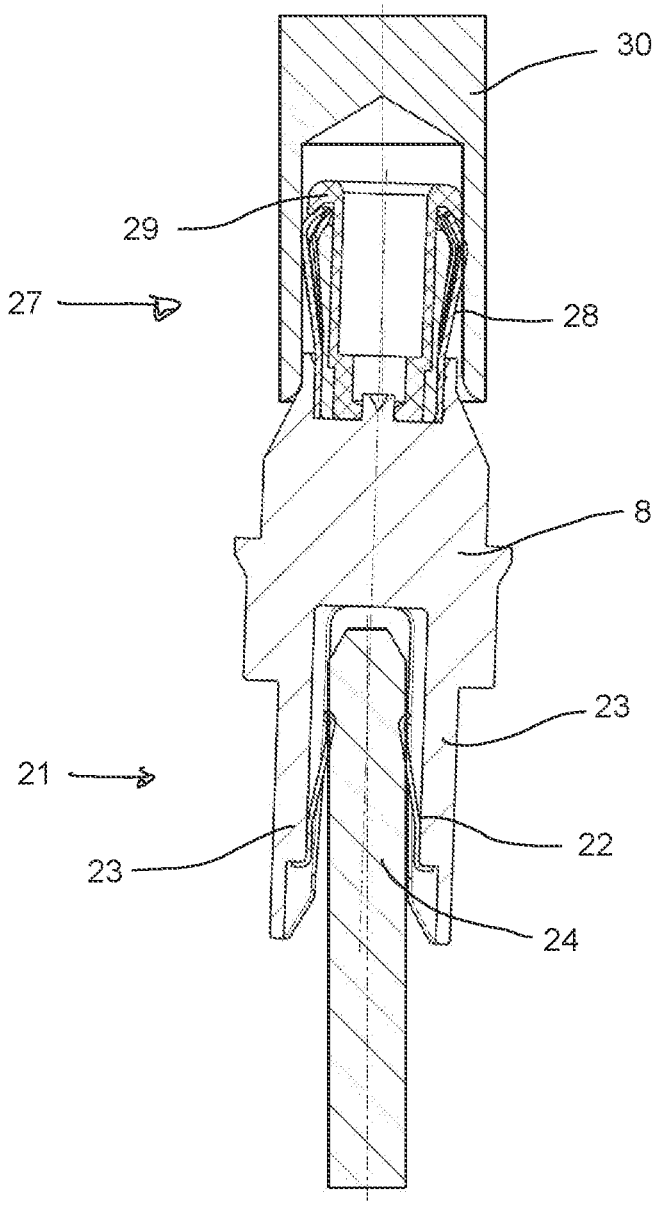
FIG. 8 A cross-sectional view of the adapter element of FIG. 7 rotated by an angle of 90° about the adaptor's longitudinal axis.

The adapter element 8 in FIGS. 7 and 8 is provided on one end with a lamella device in the form of a circularly-symmetrical stud 27 with a lamella basked 28 in a lamella carrier 29. The lamella device is mated with a matching circularly-symmetrical contact sleeve 30. On the other end, the adapter element 8 has the non-circularly-symmetrical socket 21 with a matching contact pin 24 similar to that shown in FIGS. 3 and 4. FIGS. 7 and 8 are different views of the same adapter element and matching contact sleeve 30 and contact pin 24; the view of FIG. 8 is rotated about the longitudinal axis of the adapter element by 90° relatively to the view of FIG. 7. As a result, the lamella comb 22 hidden in FIG. 7 behind the contact pin 24 can be seen in FIG. 8.

Figure 9:
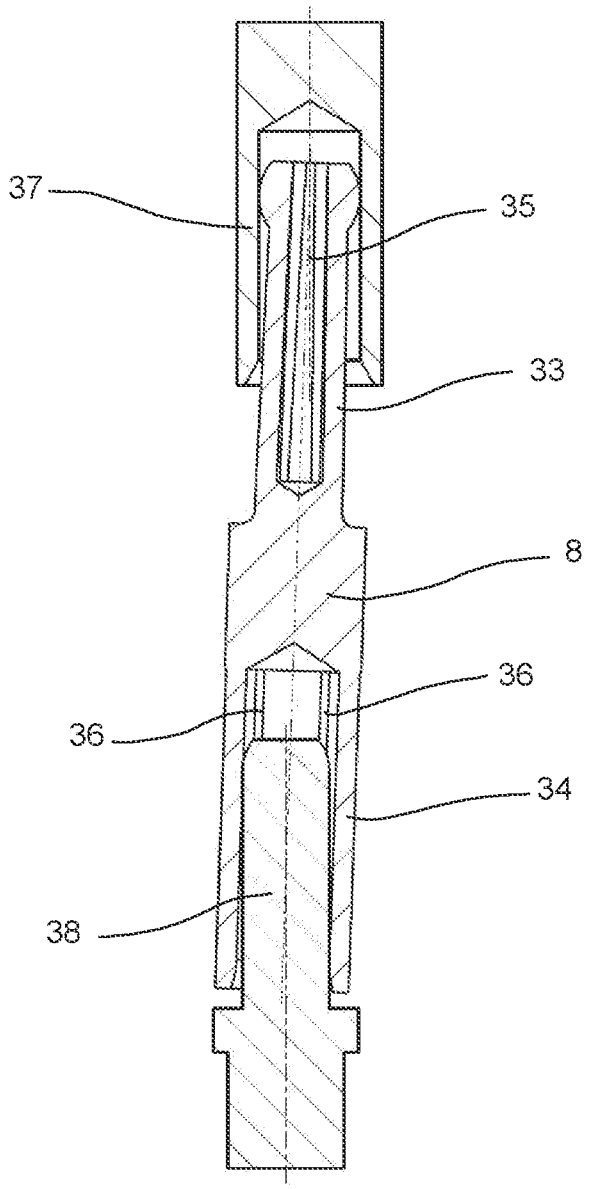
FIG. 9 A cross-sectional view of an adapter element that is provided on one end with a circularly-symmetrical stud mated with a matching circularly-symmetrical contact sleeve, and on the other end with a circularly-symmetrical socket with a matching contact pin.

Finally, in FIG. 9 an adapter element 8 is shown that has contact jacks on both sides, namely a contact pin 33 on one and a contact sleeve 34 on the other end. The adapter's 8 contact pin 33 is slotted, the slot 35 extending perpendicularly to the paper plane and in longitudinal direction of the contact pin. Similarly, the contact sleeve 34 of the adapter is provided with four equidistant slots 36, two of which can be seen in the figure. Apart form the slots 35, 36, the contact pin 33 and the contact sleeve 34 are circularly-symmetrical in cross-section. The adapter's 8 contact pin 33 and contact socket 34 are mated with a corresponding non-slotted contact sleeve 37 and a non-slotted contact pin 38, respectively. These, too, are essentially circularly-symmetrical.

The features described in the above description, claims and figures can be relevant to the invention in any combination. Their reference numerals in the claims have merely been introduced to facilitate reading of the claims. They are by no means meant to be limiting.

The invention claimed is:

1. An adaptive connector comprising:

at least one adapter element with a contact portion at a first end of the at least one adapter element, wherein the contact portion is a pin or sleeve;

a stud or socket that is fixed, wherein the stud or socket comprises at least one lamella comb, wherein the at least one lamella comb electrically contacts the contact portion of the at least one adapter element; and an elastic biasing element for biasing the at least one adapter element in a resting position, wherein the contact portion of the at least one adapter element is connected to the stud or socket in a mechanically inseparable but movable manner, wherein an alignment of the pin or sleeve relative to the stud or socket is changeable within an angular range of more than 2 degrees while maintaining contact between the contact portion and the stud or socket, and/or the pin or sleeve is translationally moveable relative to the stud or socket in at least one direction within a translational range of more than 1 millimeter.

2. The adaptive connector of claim 1, wherein the at least one lamella comb is a lamella basket.

3. The adaptive connector of claim 1, wherein each of the at least one adapter element is at least partially surrounded by the housing, and wherein the at least one biasing element biases a respective adapter element against the housing.

4. The adaptive connector of claim 1, further comprising a connection element at a second end of the at least one adapter element, wherein the connection element is a connection pin or sleeve, or a connection stud or socket.

5. The adaptive connector of claim 4, wherein the connection element comprises two lamella combs, wherein each lamella comb extends along a straight line, and wherein the straight lines of the two lamella combs are parallel to each other.

6. The adaptive connector of claim 4, further comprising one or more seals that seal the at least one adapter element against the housing to prevent a fluid from getting from the first end to the second end or from the second end to the first end of the at least one adapter element.

7. The adaptive connector of claim 4, wherein the at least one adapter element is a plurality of adapter elements, each with a respective contact portion at the first end and a respective connection element at the second end.

8. The adaptive connector of claim 7, wherein the plurality of adapter elements are electrically separate from each other and wherein the plurality of adapter elements are connected with each other in a mechanically inseparable but movable manner.

9. An adaptive connector comprising:

two or more adapter elements that are electrically separate from each other, wherein each adapter element of the two or more adapter elements comprises a first end and a second end, wherein at the first end is a first connection element, wherein at the second end is a second connection element, the first connection element being electrically connected to the second connection element, wherein each of the first and second connection elements is a pin or sleeve, or a stud or socket, wherein the two or more adapter elements are connected with each other in a mechanically inseparable but movable manner, wherein an alignment of any of the two or more adapter elements relative to at least one other of the two or more adapter elements is changeable within an angular range of more than 4 degrees, and/or any of the two or more adapter elements is translationally moveable relative to any other of the two or more adapter elements in at least one direction within a translational range of more than 2 millimeters, and wherein at least one adapter element of the two or more adapter elements is provided with an elastic biasing element for biasing the at least one adapter element in a resting position.

10. The adaptive connector of claim 9, wherein, for at least one adapter element of the two or more adapter elements, the first connection element is circularly-symmetrical and the second connection element is non-circularly-symmetrical.

11. The adaptive connector of claim 9, wherein, for at least one adapter element of the two or more adapter elements, the first connection element is a stud or socket and the second connection element is a stud or socket.

12. An adaptive connector, comprising:

at least one adapter element with a first contact portion at a first end of the at least one adapter element, wherein the first contact portion is a first pin or first sleeve;

a second contact portion that is fixed, wherein the second contact portion is a second sleeve if the first contact portion is the first pin, wherein the second contact portion is a second pin if the first contact portion is the first sleeve; and an elastic biasing element for biasing the at least one adapter element in a resting position, wherein the first contact portion and the second contact portion electrically contact each other, wherein the first contact portion and the second contact portion are connected in a mechanically inseparable but movable manner with each other, and wherein an alignment of the first contact portion relative to the second contact portion is changeable within an angular range of more than 2 degrees while maintaining the electrical contact, and/or the first contact portion is translationally moveable relative to the second contact portion in at least one direction within a translational range of more than 1 millimeter.

13. A connector system, comprising:

an adaptive connector, comprising at least one adapter element with a contact portion at a first end of the at least one adapter element, wherein the contact portion is a pin or sleeve;

a stud or socket that is fixed, wherein the stud or socket comprises at least one lamella comb, wherein the at least one lamella comb electrically contacts the contact portion of the at least one adapter element;

an elastic biasing element for biasing the at least one adapter element in a resting position; and a connection element at a second end of the at least one adapter element, wherein the connection element is a connection pin or sleeve, or a connection stud or socket, wherein the contact portion of the at least one adapter element is connected to the stud or socket in a mechanically inseparable but movable manner, wherein an alignment of the pin or sleeve relative to the stud or socket is changeable within an angular range of more than 2 degrees while maintaining contact between the contact portion and the stud or socket, and/or the pin or sleeve is translationally moveable relative to the stud or socket in at least one direction within a translational range of more than 1 millimeter; and a counter connector comprising, if the connection element of the at least one adapter element is a pin or sleeve, a matching connection element that is socket or stud, or if the connection element of the at least one adapter element is a stud or socket, a matching connection element that is a sleeve or pin, wherein the adaptive connector is able to mate with the counter connector to establish an electrical contact between:

each connection pin or sleeve of the adaptive connector with the matching connection socket or stud of the counter connector, and/or each connection stud or socket of the adaptive connector with the matching connection sleeve or pin of the counter connector.

14. The connector system of claim 13, further comprising one or more seals that seal the matching connection element of the counter connector against a housing of the adaptive connector to prevent a fluid from getting from an outside of the housing of the adaptive connector and the counter connector to the matching connection element of the counter connector.

15. An adaptive connector comprising:

at least one adapter element with a stud or socket attached at a first end of the at least one adapter element, wherein the stud or socket comprises at least one lamella comb;

a contact pin or contact sleeve that is fixed; and an elastic biasing element for biasing the at least one adapter element in a resting position, wherein the stud or socket of the at least one adapter element is connected to the contact pin or contact sleeve in a mechanically inseparable but movable manner, and wherein an alignment of the stud or socket relative to the contact pin or contact sleeve is changeable within an angular range of more than 2 degrees while maintaining contact between the stud or socket and the contact pin or contact sleeve, and/or the stud or socket is translationally moveable relative to the contact pin or contact sleeve in at least one direction within a translational range of more than 1 millimeter.

* * * * *